US009932213B2

(12) United States Patent
Buchmann et al.

(10) Patent No.: US 9,932,213 B2
(45) Date of Patent: Apr. 3, 2018

(54) LIFT TRUCK WITH OPTICAL LOAD SENSING STRUCTURE

(71) Applicant: Crown Equipment Corporation, New Bremen, OH (US)

(72) Inventors: Jürgen Buchmann, Plienig (DE); Thomas Gumpp, Forstinning (DE); Andreas Simon, Munich (DE)

(73) Assignee: Crown Equipment Corporation, New Bremen, OH (US)

( * ) Notice: Subject to any disclaimer, the term of this patent is extended or adjusted under 35 U.S.C. 154(b) by 395 days.

(21) Appl. No.: 14/847,087

(22) Filed: Sep. 8, 2015

(65) Prior Publication Data

US 2016/0075542 A1 Mar. 17, 2016

Related U.S. Application Data

(60) Provisional application No. 62/050,239, filed on Sep. 15, 2014.

(51) Int. Cl.
*B66F 9/075* (2006.01)
*B66F 9/07* (2006.01)
(Continued)

(52) U.S. Cl.
CPC ..... *B66F 9/0755* (2013.01); *B66F 9/07* (2013.01); *B66F 9/07559* (2013.01);
(Continued)

(58) Field of Classification Search
CPC ..... B66F 9/0755; B66F 9/07; B66F 9/122; B66F 9/07559; B66F 9/146; B66F 9/147; B66F 17/003
(Continued)

(56) References Cited

U.S. PATENT DOCUMENTS 3,854,820 A 12/1974 Hansen
5,299,906 A 4/1994 Stone
(Continued)

FOREIGN PATENT DOCUMENTS

BE 1013354 A3 12/2001
BE 1018160 A3 6/2010
(Continued)

OTHER PUBLICATIONS

Ross, Kenneth; International Search Report and Written Opinion of the International Searching Authority; International Application No. PCT/US2015/048814; dated Mar. 3, 2016; European Patent Office.

*Primary Examiner* — Anthony Salata
(74) *Attorney, Agent, or Firm* — Stevens & Showalter, LLP

(57) ABSTRACT

A lift truck includes a frame, a pair of laterally spaced apart outriggers extending from the frame, and a load handling assembly secured to the frame adjacent to the outriggers. The load handling assembly includes a mast assembly positioned between the outriggers and a carriage assembly including fork structure for supporting a load on the load handling assembly. The carriage assembly is movable vertically along the mast assembly and laterally with respect to the mast assembly. Optical sensor structure of the truck monitors for conditions wherein movement of the carriage assembly would result in contact between the load and the outrigger(s). A vehicle controller receives a signal from the optical sensor structure and prevents movement of the carriage assembly toward the outrigger(s) if the signal from the optical sensor structure indicates that such movement would result in contact between the load and the outrigger(s).

26 Claims, 9 Drawing Sheets

(51) Int. Cl.
*B66F 9/12* (2006.01)
*B66F 9/14* (2006.01)
*B66F 17/00* (2006.01)

(52) U.S. Cl.
CPC ..... *B66F 9/122* (2013.01); *B66F 9/146* (2013.01); *B66F 9/147* (2013.01); *B66F 17/003* (2013.01)

(58) Field of Classification Search
USPC ..... 187/223, 224, 225, 226, 232, 391; 701/50; 340/435, 436, 518, 522, 543.3, 340/555; 414/663, 664, 667
See application file for complete search history.

(56) References Cited

U.S. PATENT DOCUMENTS 5,462,136 A 10/1995 Schoenmaker et al.
5,490,758 A 2/1996 Stone
5,586,620 A * 12/1996 Dammeyer ..... B66F 9/0755 187/227
5,780,936 A * 7/1998 Cardello ..... E06C 5/36 187/232
5,782,602 A 7/1998 Mehta et al.
5,938,710 A 8/1999 Lanza et al.
6,135,694 A 10/2000 Trego et al.
6,150,938 A 11/2000 Sower et al.
6,269,913 B1 * 8/2001 Kollmannsberger ..... B66F 9/06 187/222
6,388,748 B1 5/2002 Kokura
6,615,953 B1 * 9/2003 Steinweg ..... B66B 9/187 187/300
6,795,187 B2 9/2004 Kokura
6,877,945 B2 4/2005 Ando et al.
6,991,067 B2 * 1/2006 Dube ..... B66F 11/04 187/223
7,165,652 B2 1/2007 Allerding et al.
7,194,358 B2 * 3/2007 Callaghan ..... B66B 5/0031 182/112
7,287,625 B1 10/2007 Harris
8,220,169 B2 7/2012 Goddard
8,538,577 B2 9/2013 Bell et al.
8,763,759 B2 7/2014 Viereck et al.
9,230,419 B2 * 1/2016 Beggs ..... B60Q 1/2673
9,327,953 B2 * 5/2016 Sayles ..... B66F 11/04
9,336,660 B2 * 5/2016 McIntosh ..... B66F 17/006
2004/0226776 A1 11/2004 Allerding et al.
2008/0011554 A1 1/2008 Broesel et al.
2011/0234389 A1 9/2011 Mellin
2014/0133944 A1 5/2014 Pangrazio et al.
2014/0158468 A1 6/2014 Adami
2014/0159881 A1 6/2014 Adami

FOREIGN PATENT DOCUMENTS

DE 4430056 A1 3/1995
DE 4442689 A1 6/1995
DE 4413538 A1 10/1995
DE 4428010 A1 2/1996
DE 19503198 C1 2/1996
DE 19503199 C1 2/1996
DE 4434328 A1 3/1996
DE 19508346 C1 6/1996
DE 19534291 A1 3/1997
DE 19609007 A1 9/1997
DE 19719536 A1 1/1998
DE 19722345 A1 11/1998
DE 19857022 A1 6/1999
DE 10010011 A1 2/2001
DE 10005958 A1 3/2001
DE 10004622 A1 5/2001
DE 19960587 A1 6/2001
DE 10101705 A1 7/2001
DE 10105295 A1 8/2001
DE 10015707 A1 10/2001
DE 10021822 A1 11/2001
DE 10028808 A1 1/2002
DE 10039382 A1 2/2002
DE 10039507 A1 2/2002
DE 10100357 A1 8/2002
DE 10114571 A1 9/2002
DE 10130246 A1 1/2003
DE 10207017 A1 8/2003
DE 10245462 A1 8/2003
DE 10259704 A1 8/2003
DE 10010670 C2 11/2003
DE 10259470 A1 7/2004
DE 202004008238 U1 8/2004
DE 10305902 A1 9/2004
DE 202004013362 U1 11/2004
DE 10321569 A1 12/2004
DE 10323642 A1 1/2005
DE 10323643 A1 1/2005
DE 69822358 T2 2/2005
DE 102004001197 A1 8/2005
DE 102004018021 A1 11/2005
DE 102004019914 A1 11/2005
DE 10015009 B4 2/2006
DE 102004040065 A1 2/2006
DE 102004047212 A1 4/2006
DE 202006013417 U1 11/2006
DE 102005048355 A1 4/2007
DE 102006009331 A1 9/2007
DE 102006020491 A1 10/2007
DE 102006037928 A1 2/2008
DE 102006054850 A1 5/2008
DE 202007002303 U1 6/2008
DE 102007023774 A1 11/2008
DE 202009002188 U1 5/2009
DE 102007059699 A1 6/2009
DE 102008027695 A1 10/2009
DE 102008027701 A1 10/2009
DE 102008030546 A1 12/2009
DE 10260771 B4 4/2010
DE 102009036440 A1 5/2010
DE 102009034976 A1 2/2011
DE 202011003546 U1 10/2011
DE 102010019225 A1 11/2011
DE 102010048662 A1 4/2012
DE 102010052757 A1 5/2012
DE 102011012415 A1 8/2012
DE 102011012416 A1 8/2012
DE 102011016542 A1 10/2012
DE 102011018506 A1 10/2012
DE 102011103029 A1 12/2012
DE 102011103214 A1 12/2012
DE 102012100356 A1 7/2013
DE 102012200522 A1 7/2013
DE 102012101734 A1 9/2013
DE 102012010248 A1 11/2013
DE 102012015217 A1 2/2014
DE 102012109530 A1 4/2014
DE 102012219207 A1 4/2014
EP 0659679 A1 6/1995
EP 0712697 A2 5/1996
EP 0716040 A1 6/1996
EP 0774243 A2 5/1997
EP 0800129 A1 10/1997
EP 0802153 A1 10/1997
EP 0803717 A1 10/1997
EP 0824496 A1 2/1998
EP 0655403 B1 10/1998
EP 0870727 A2 10/1998
EP 0884202 A2 12/1998
EP 0905083 A1 3/1999
EP 0915053 A2 5/1999
EP 0921021 A2 6/1999
EP 0924160 A2 6/1999
EP 0943582 A2 9/1999
EP 0959038 A2 11/1999
EP 0669281 B1 3/2000
EP 0985632 A1 3/2000
EP 0995557 A2 4/2000

(56) References Cited

FOREIGN PATENT DOCUMENTS

| | | | |
|---|---|---|---|
| EP | 1038826 | A1 | 9/2000 |
| EP | 1043268 | A1 | 10/2000 |
| EP | 1078878 | A1 | 2/2001 |
| EP | 1103494 | A1 | 5/2001 |
| EP | 1123835 | A1 | 8/2001 |
| EP | 1139117 | A1 | 10/2001 |
| EP | 1203743 | A1 | 5/2002 |
| EP | 1203744 | A1 | 5/2002 |
| EP | 1245524 | A2 | 10/2002 |
| EP | 1270495 | A1 | 1/2003 |
| EP | 1293472 | A2 | 3/2003 |
| EP | 1300595 | A2 | 4/2003 |
| EP | 1331133 | A2 | 7/2003 |
| EP | 1371601 | A2 | 12/2003 |
| EP | 1371602 | A2 | 12/2003 |
| EP | 1408001 | A1 | 4/2004 |
| EP | 1422189 | A1 | 5/2004 |
| EP | 1447374 | A2 | 8/2004 |
| EP | 1447376 | A1 | 8/2004 |
| EP | 1468958 | A2 | 10/2004 |
| EP | 1258450 | A3 | 2/2005 |
| EP | 1502896 | A1 | 2/2005 |
| EP | 1591411 | A2 | 11/2005 |
| EP | 1593642 | A2 | 11/2005 |
| EP | 1593645 | A2 | 11/2005 |
| EP | 1604942 | A2 | 12/2005 |
| EP | 1621440 | A2 | 2/2006 |
| EP | 1318099 | B1 | 3/2006 |
| EP | 1669320 | A1 | 6/2006 |
| EP | 1695925 | A1 | 8/2006 |
| EP | 1398292 | B1 | 11/2006 |
| EP | 1728758 | A2 | 12/2006 |
| EP | 1728759 | A2 | 12/2006 |
| EP | 1760032 | A2 | 3/2007 |
| EP | 1764340 | B1 | 3/2007 |
| EP | 1770053 | A2 | 4/2007 |
| EP | 1829812 | A2 | 9/2007 |
| EP | 1829815 | A2 | 9/2007 |
| EP | 1834922 | A2 | 9/2007 |
| EP | 1925513 | A1 | 5/2008 |
| EP | 1985577 | A2 | 10/2008 |
| EP | 2042276 | A2 | 4/2009 |
| EP | 2060472 | A2 | 5/2009 |
| EP | 2072422 | A1 | 6/2009 |
| EP | 2110293 | A2 | 10/2009 |
| EP | 2123596 | A1 | 11/2009 |
| EP | 2168904 | A1 | 3/2010 |
| EP | 2172413 | A1 | 4/2010 |
| EP | 2181959 | A1 | 5/2010 |
| EP | 2189577 | A1 | 5/2010 |
| EP | 2208704 | A1 | 7/2010 |
| EP | 2260818 | A1 | 12/2010 |
| EP | 2263966 | A1 | 12/2010 |
| EP | 1258451 | B1 | 3/2011 |
| EP | 2298688 | A2 | 3/2011 |
| EP | 2305594 | A1 | 4/2011 |
| EP | 2345620 | A1 | 7/2011 |
| EP | 2354078 | A1 | 8/2011 |
| EP | 2390222 | A1 | 11/2011 |
| EP | 2444362 | A1 | 4/2012 |
| EP | 2447203 | A1 | 5/2012 |
| EP | 2492164 | A2 | 8/2012 |
| EP | 2518002 | A1 | 10/2012 |
| EP | 2518003 | A1 | 10/2012 |
| EP | 2527288 | A1 | 11/2012 |
| EP | 2567933 | A1 | 3/2013 |
| EP | 2574589 | A1 | 4/2013 |
| EP | 2574590 | A1 | 4/2013 |
| EP | 2636637 | A1 | 9/2013 |
| EP | 2641862 | A1 | 9/2013 |
| EP | 0775666 | A1 | 10/2013 |
| EP | 2653429 | A1 | 10/2013 |
| EP | 2653430 | A1 | 10/2013 |
| EP | 2698337 | A1 | 2/2014 |
| FR | 2815450 | A1 | 4/2002 |
| FR | 2849816 | A1 | 7/2004 |
| FR | 2868764 | A1 | 10/2005 |
| FR | 2877934 | A1 | 5/2006 |
| GB | 0114435 | A | 3/1918 |
| GB | 0208370 | A | 12/1923 |
| GB | 0210040 | A | 7/1924 |
| GB | 0327240 | A | 4/1930 |
| GB | 0705153 | A | 3/1954 |
| GB | 0707822 | B | 4/1954 |
| GB | 0803856 | A | 11/1958 |
| GB | 0904858 | A | 8/1962 |
| GB | 0912874 | A | 12/1962 |
| GB | 966227 | | 8/1964 |
| GB | 970765600 | A | 11/1997 |
| JP | H09235095 | A | 9/1997 |
| JP | 2003300699 | A | 10/2003 |
| WO | 9606795 | A1 | 3/1996 |
| WO | 9747494 | A1 | 12/1997 |
| WO | 9855388 | A1 | 12/1998 |
| WO | 9902445 | A1 | 1/1999 |
| WO | 9916698 | A1 | 4/1999 |
| WO | 200075736 | A1 | 12/2000 |
| WO | 200158789 | A1 | 8/2001 |
| WO | 02064484 | A1 | 8/2002 |
| WO | 02064490 | A1 | 8/2002 |
| WO | 03037777 | A1 | 5/2003 |
| WO | 03070617 | A1 | 8/2003 |
| WO | 03086944 | A1 | 10/2003 |
| WO | 03100349 | A2 | 12/2003 |
| WO | 2004015510 | A1 | 2/2004 |
| WO | 2004016541 | A1 | 2/2004 |
| WO | 2004048148 | A1 | 6/2004 |
| WO | 2004069568 | A1 | 8/2004 |
| WO | 2004085198 | A2 | 10/2004 |
| WO | 2004103882 | A1 | 12/2004 |
| WO | 2005054111 | A1 | 6/2005 |
| WO | 2006008586 | A1 | 1/2006 |
| WO | 2006037841 | A1 | 4/2006 |
| WO | 2006124433 | A2 | 11/2006 |
| WO | 2007063188 | A1 | 6/2007 |
| WO | 2007088379 | A1 | 8/2007 |
| WO | 2006113363 | A3 | 10/2007 |
| WO | 2008040853 | A1 | 4/2008 |
| WO | 2008065237 | A1 | 6/2008 |
| WO | 2008085295 | A2 | 7/2008 |
| WO | 2008092253 | A1 | 8/2008 |
| WO | 2008115942 | A1 | 9/2008 |
| WO | 2006113364 | A3 | 4/2009 |
| WO | 2009130528 | A1 | 10/2009 |
| WO | 2009132219 | A1 | 10/2009 |
| WO | 2009141242 | A1 | 11/2009 |
| WO | 2010024838 | A1 | 3/2010 |
| WO | 2010053432 | A1 | 5/2010 |
| WO | 2010054785 | A1 | 5/2010 |
| WO | 2010091219 | A1 | 8/2010 |
| WO | 2010120185 | A1 | 10/2010 |
| WO | 2010140880 | A2 | 12/2010 |
| WO | 2010146089 | A1 | 12/2010 |
| WO | 2011032744 | A1 | 3/2011 |
| WO | 2011108944 | A2 | 9/2011 |
| WO | 2011128917 | A1 | 10/2011 |
| WO | 2011154519 | A1 | 12/2011 |
| WO | 2012022598 | A1 | 2/2012 |
| WO | 2012022600 | A1 | 2/2012 |
| WO | 2012065157 | A1 | 5/2012 |
| WO | 2012097125 | A1 | 7/2012 |
| WO | 2013013821 | A1 | 1/2013 |
| WO | 2013055585 | A1 | 4/2013 |
| WO | 201310222 | A1 | 7/2013 |
| WO | 2013134094 | A1 | 9/2013 |
| WO | 2014006472 | A1 | 1/2014 |
| WO | 2014070257 | A1 | 5/2014 |
| WO | 2014104957 | A1 | 7/2014 |
| WO | 2014111238 | A1 | 7/2014 |

* cited by examiner

LIFT TRUCK WITH OPTICAL LOAD SENSING STRUCTURE

CROSS REFERENCE TO RELATED APPLICATION

This application claims the benefit of U.S. Provisional Patent Application Ser. No. 62/050,239, filed Sep. 15, 2014, and entitled "LIFT TRUCK WITH OPTICAL LOAD SENSING STRUCTURE," the entire disclosure of which is hereby incorporated by reference herein.

FIELD OF THE INVENTION

The present invention relates generally to sensor structure for lift trucks, and more particularly, to optical load sensors that sense impending contact between a load carried by a load handling assembly of the truck and laterally spaced outriggers extending from the truck frame.

BACKGROUND OF THE INVENTION

In warehouses and similar environments, lift trucks are typically used to pick up and deliver goods for further transport or processing. One type of lift truck comprises a load handling assembly including a mast assembly and a carriage assembly comprising a pair of laterally spaced apart forks, wherein the carriage assembly is laterally movable via a sideshift assembly. This type of lift truck also includes laterally spaced apart outriggers adjacent to the forks.

When the load handling assembly is located in a home or fully lowered and retracted position, the mast assembly, carriage assembly, and forks are located between the outriggers and the forks are vertically positioned in plane with the outriggers. However, when the carriage assembly is lifted and/or when the mast assembly or carriage assembly is moved longitudinally away from the truck frame, the load handling assembly is moved from its home position. When a reach-in function (where the mast or carriage assembly is moved longitudinally back toward the home position) or a lowering function (where the carriage assembly and the forks are lowered back toward the home position) is requested, steps must be taken once the load handling assembly reaches a predetermined threshold height to ensure that the forks and/or a load carried by the forks do not contact the outriggers.

Such steps include an operator visually inspecting the position of the forks/load and activating an override command to allow continued movement of the load handling assembly back to the home position. If the operator determines that contact will or may occur between the forks/load and the outriggers, steps must be taken by the operator, e.g., adjusting the position of the forks/load with the sideshift assembly or repositioning the load, to clear the forks/load of the outriggers before continued movement of the load handling assembly back to the home position can be carried out.

BRIEF SUMMARY OF THE INVENTION

The present invention relates to lift trucks that include sensor structure for detecting potential contact between a load carried by the forks and outriggers of the truck extending longitudinally away from a truck frame.

In accordance with an aspect of the present invention, a lift truck is provided comprising a frame defining a main structural component of the lift truck; a pair of laterally spaced apart outriggers extending from the frame, each outrigger including at least one wheel; a vehicle controller for controlling at least one function of the lift truck; and a load handling assembly secured to the frame adjacent to the outriggers. The load handling assembly comprises a mast assembly positioned between the outriggers and a carriage assembly including fork structure for supporting a load on the load handling assembly. The carriage assembly is movable vertically along the mast assembly and is also moveable laterally with respect to the mast assembly via a sideshift assembly. The lift truck further comprises optical sensor structure that monitors for conditions wherein movement of the carriage assembly would result in contact between the load and at least one of the outriggers. The vehicle controller receives a signal from the optical sensor structure and prevents movement of the carriage assembly in a direction toward the at least one of the outriggers if the signal from the optical sensor structure indicates that such movement would result in contact between the load and the at least one of the outriggers.

The fork structure may comprise a pair of laterally spaced apart forks extending longitudinally away from the frame.

The optical sensor structure may comprise a pair of laterally spaced apart contactless optical sensors, each contactless optical sensor being located adjacent to a corresponding outrigger. Each contactless optical sensor may monitor a respective area around the corresponding outrigger for a portion of the load to enter the respective area, wherein a portion of the load entering the respective area causes the vehicle controller to prevent movement of the carriage assembly toward the at least one of the outriggers. The area monitored by each contactless optical sensor may extend longitudinally forward from and vertically downward from the respective contactless optical sensor. The contactless optical sensors, which may be laser sensors, may be located laterally inwardly of the corresponding outriggers, and may be affixed to the mast assembly.

The vehicle controller may be capable of operating the sideshift assembly to cause the carriage assembly to move to a position such that the load is centered with respect to the outriggers if the signal from the optical sensor structure indicates that movement of the carriage assembly toward at least one of the outriggers would result in contact between the load and the at least one of the outriggers. The vehicle controller may operate the sideshift assembly to cause the carriage assembly to move only upon authorization to do so by an operator. The controller may discontinue attempting to center the load with respect to the outriggers after the expiration of a predetermined time period.

The load handling assembly may only be movable to a home position if the signal from the optical sensor structure does not indicate that such movement would result in contact between the load and the outriggers.

The mast assembly may be movable in a longitudinal direction relative to the frame, and the optical sensor structure may also monitor for conditions wherein movement of the mast assembly would result in contact between the load and at least one of the outriggers. Further, the vehicle controller may also prevent movement of the mast assembly in a direction toward the at least one of the outriggers if the signal from the optical sensor structure indicates that such movement would result in contact between the load and the at least one of the outriggers.

The lift truck may further comprise a control element that is adapted to be implemented by an operator to override the prevention of movement of the carriage assembly in the direction toward the at least one of the outriggers even if the signal from the optical sensor structure indicates that such movement would result in contact between the load and the at least one of the outriggers. The operator may be able to override the prevention of movement of the carriage assembly in the direction toward the at least one of the outriggers for as long as the operator implements the control element.

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
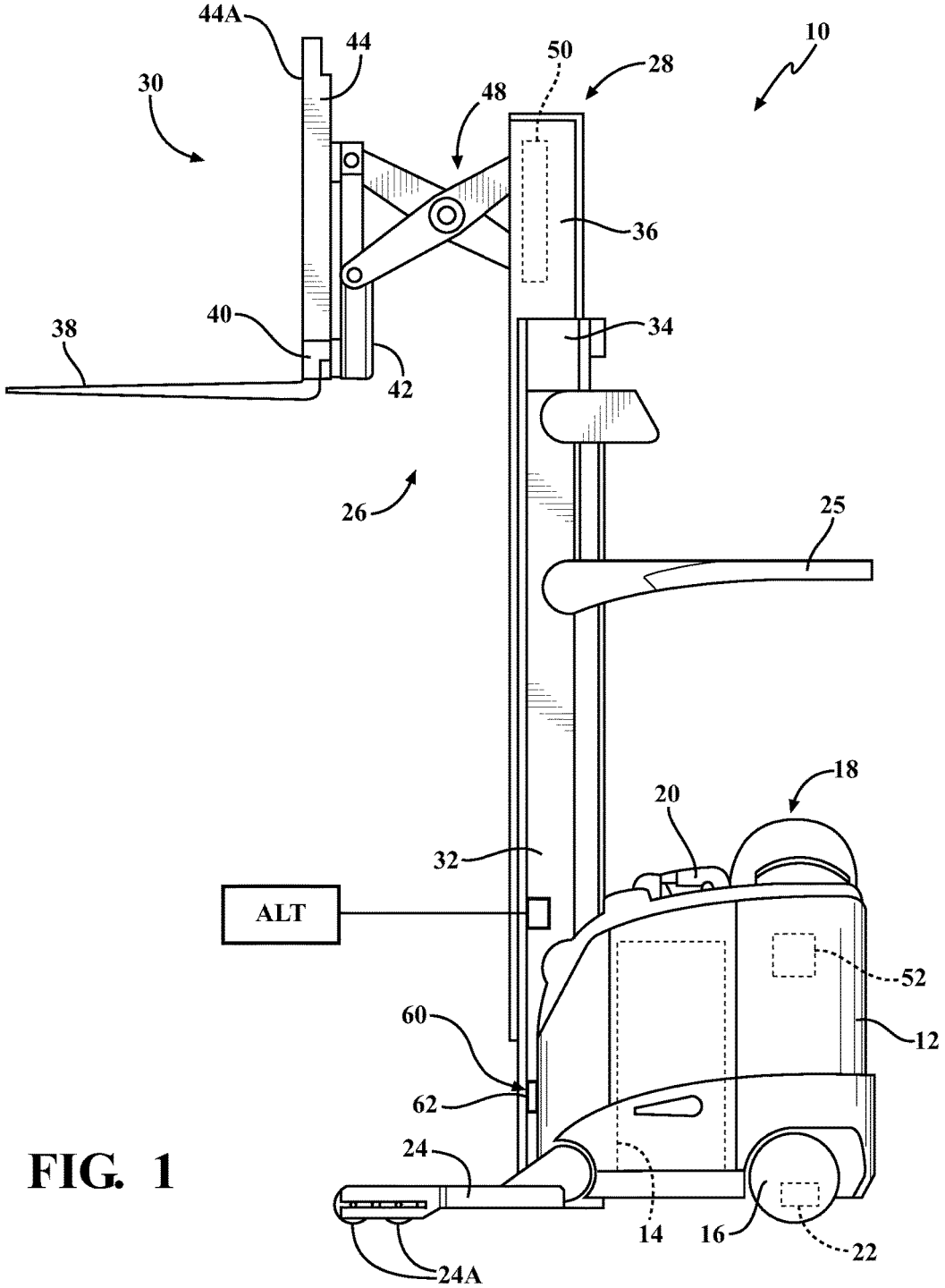
FIG. 1 is a side view of a lift truck according to an aspect of the present invention.

FIG. 1 illustrates a rider reach fork lift truck 10 according to an aspect of the present invention. The truck 10 includes a frame 12 defining a main structural component and which houses a battery 14 for supplying power to a traction motor (not shown) connected to a steerable wheel 16 and to one or more hydraulic motors (not shown), which supply power to several different systems, such as hydraulic cylinders for effecting generally vertical movement of movable mast members 34, 36, generally vertical movement of a carriage assembly 30 relative to mast member 36, generally longitudinal movement of a scissors reach assembly 48, and generally transverse movement of a fork carriage 40 relative to a carriage plate 42. The traction motor and the steerable wheel 16 define a drive mechanism for effecting movement of the truck 10. An operator's compartment 18 in the frame 12 is provided with a steering tiller (not shown) for controlling the direction of travel of the truck 10, and a control handle 20 for controlling travel speed as well as fork height, extension, sideshift, and tilt. The speed of the truck 10 is measured by a tachometer, represented at 22, included within the truck 10 in a conventional manner. A pair of outriggers 24, each including at least one wheel 24A, extends longitudinally from the frame 12, and an overhead guard 25 is placed over the operator's compartment 18.

A load handling assembly 26 of the truck 10 includes, generally, a mast assembly 28 and the carriage assembly 30, which is movable vertically along the mast assembly 28. The mast assembly 28 is positioned between the outriggers 24 and includes a fixed mast member 32 affixed to the frame 12, and nested lower and upper movable mast members 34, 36. As noted above, hydraulic cylinders (not shown) are provided for effecting movement of lower and upper mast members 34, 36, the carriage assembly 30, the reach assembly 48 and the fork carriage 40.

The carriage assembly 30 includes fork structure comprising a pair of forks 38 mounted to the fork carriage 40, which is in turn mounted to the carriage plate 42 of the carriage assembly 30. As shown in FIG. 1, a load backrest 44 of the carriage assembly 30 extends generally vertically relative to the forks 38 and defines a surface 44A that provides a back stop for a load carried on the forks 38.

As described in U.S. Pat. No. 5,586,620, which is incorporated herein by reference, the carriage plate 42 is attached to the upper mast member 36 of the mast assembly 28 by the scissors reach mechanism 48 of the carriage assembly 30. The reach mechanism 48 extends between the carriage plate 40 and a reach support 50, which is mounted to the upper mast member 36 as shown in FIG. 1 for vertical movement relative to and with the upper mast member 36.

An electrical proportional hydraulic valve (not shown) coupled to a vehicle controller 52 controls and directs hydraulic fluid to the mast assembly hydraulic cylinders. An operator controls the height of the forks 38 via the control handle 20, which is also coupled to the controller 52. In response to receiving fork elevation command signals from the handle 20, the controller 52 generates control signals of an appropriate pulse width to the valve and further generates control signals so as to operate one or more hydraulic fluid pumps (not shown) at an appropriate speed to raise the forks 38. In response to receiving fork lowering command signals from the handle 20, the controller 52 generates control signals of an appropriate pulse width to the valve so as to lower the forks 38. The control handle 20 is also used to control extension and retraction of the reach mechanism 48, as well as sideshift functions of the carriage assembly 30, which will be described in greater detail below. As shown in FIG. 1, the movable mast members 34, 36, as well as the reach support 50, are raised, and the reach mechanism 48 is extended. As used herein, the term "controller" is meant to encompass a single master controller or multiple dedicated controllers that control one or more functions of the truck 10.

The truck 10 also includes optical sensor structure 60, which in the embodiment shown comprises first and second contactless optical, e.g., laser, sensors 62 (only one sensor 62 is shown in FIG. 1) affixed to opposed outer sides of the fixed mast member 32. The sensors 62 are preferably located adjacent, i.e., in close proximity to the outriggers 24, although the sensors 62 could be located in other suitable locations, such as the alternate location marked in FIG. 1 as ALT. As will be described in greater detail herein, the sensors 62 monitor respective areas around the outriggers 24 for a portion of a load carried on the forks 38 to enter the respective area, wherein signals from the sensors 62 are sent to the controller 52. The controller 52 uses the signals from the sensors 62 to ensure that contact between the load and the outriggers 24 does not occur, e.g., as a result of longitudinal, vertical, or lateral movement of the carriage assembly 30 toward a home position, to be described below.

Figure 2:
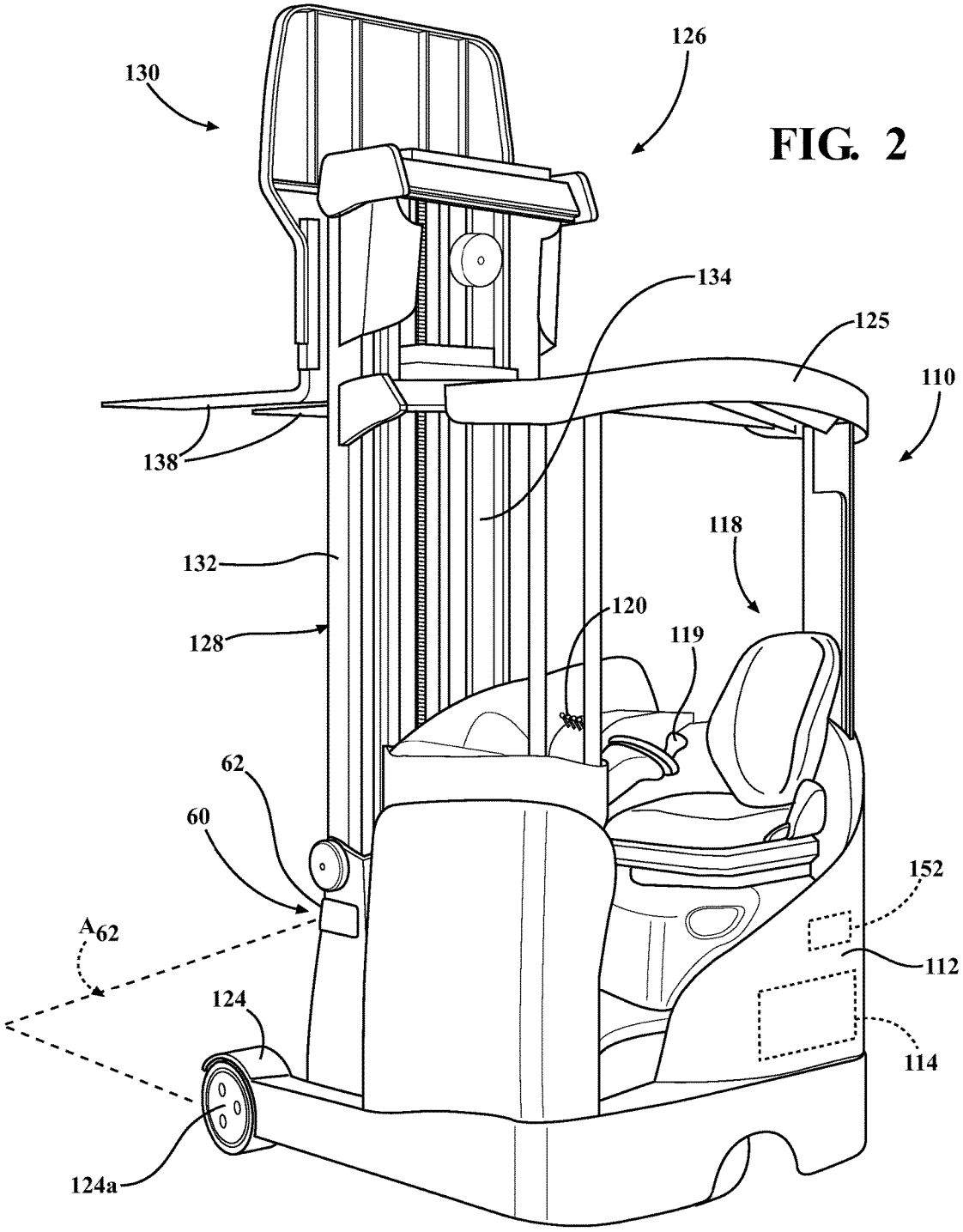
FIGS. 2 and 3 are perspective views of another lift truck according to an aspect of the present invention.
Figure 3:
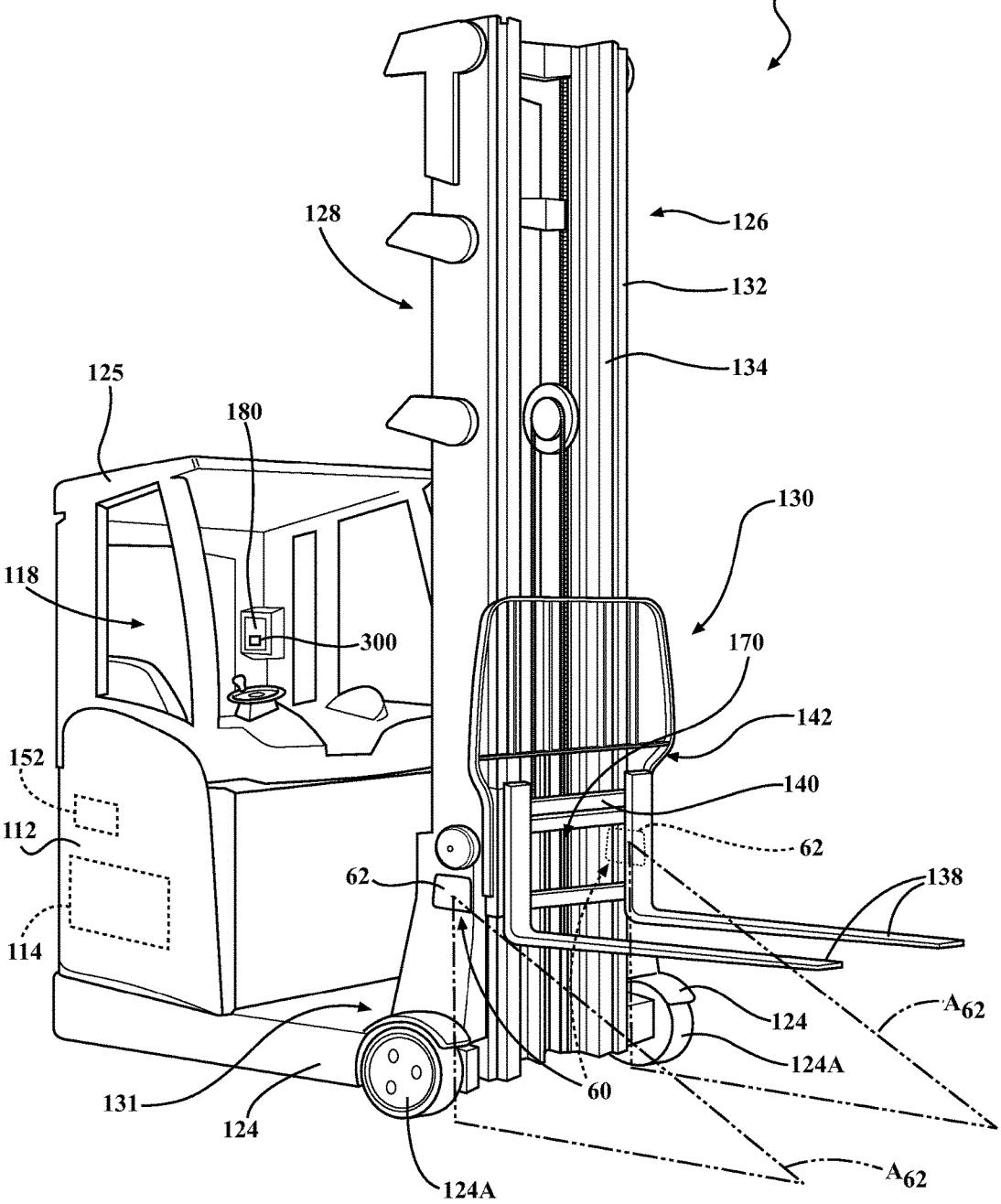

FIGS. 2 and 3 illustrate another type of lift truck 110 that the sensor structure 60 described above is usable with. The lift truck 110 shown in FIGS. 2 and 3 includes a frame 112 defining a main structural component and which houses a battery 114 for supplying power to a traction motor (not shown) connected to a steerable wheel (not shown) and to one or more hydraulic motors (not shown) which supply power to several different systems, such as mast and fork hydraulic cylinders. The traction motor and the steerable wheel define a drive mechanism for effecting movement of the truck 110. An operator's compartment 118 in the frame 112 is provided with a steering control 119 (see FIG. 2) for controlling the direction of travel of the truck 110, and a control handle 120 for controlling fork height, mast extension, sideshift, and tilt. A pair of outriggers 124, each including at least one wheel 124A, extends longitudinally from the frame 112. An overhead guard 125 is placed over the operator's compartment 118.

A load handling assembly 126 of the truck 110 includes, generally, a mast assembly 128, a carriage assembly 130 mounted to the mast assembly 128, and a displacement assembly 131 to which the mast assembly 128 is mounted. The displacement assembly 131 is longitudinally movable relative to the frame 112. The carriage assembly 130 is movable vertically along and with the mast assembly 128. The mast assembly 128 is positioned between the outriggers 124, and in the embodiment shown comprises lower and upper mast sections 132, 134, although the truck 110 could include additional or fewer mast sections without departing from the scope and spirit of the invention. A mast assembly hydraulic cylinder is provided to effect movement of the upper mast section 134 relative to the lower mast section 132. A tilt hydraulic cylinder is provided for effecting tilting movement of the mast assembly 128 relative to the displacement assembly 131. As noted above, the mast assembly 128 is movable longitudinally relative to the frame 112, i.e., the mast assembly 128 is capable of movement generally horizontally and generally parallel to level ground toward and away from the frame 112 via the displacement assembly 131 (the mast assembly 128 is shown in a refracted position, e.g., adjacent to the frame 112 in FIG. 2, and an extracted position, e.g., spaced from the frame 112 in FIG. 3). The operation of the displacement assembly 131 is conventional and will not be described in detail herein.

The carriage assembly 130 includes fork structure comprising a pair of forks 138 mounted to a fork carriage 140. The fork carriage 140 is mounted to a lifting carriage 142 (see FIG. 3), which is in turn mounted to the mast assembly 128 in a conventional manner. A conventional sideshift assembly 170 comprising a sideshift hydraulic cylinder is provided for effecting lateral or transverse movement of the fork carriage 140 relative to the lifting carriage 142. It is noted that the fork carriage 140 may be tiltable relative to the lifting carriage 142 in lieu of the mast assembly 128 being tiltable relative to the displacement assembly 131.

An electrical proportional hydraulic valve (not shown) coupled to a vehicle controller 152 controls and directs hydraulic fluid to the mast assembly and carriage assembly hydraulic cylinders. An operator controls the height of the forks 138 via the control handle 120, which is also coupled to the controller 152. In response to receiving fork elevation command signals from the handle 120, the controller 152 generates control signals of an appropriate pulse width to the valve and further generates control signals so as to operate one or more hydraulic fluid pumps (not shown) at an appropriate speed to raise the forks 138. In response to receiving fork lowering command signals from the handle 120, the controller 152 generates control signals of an appropriate pulse width to the valve so as to lower the forks 138. The controller 120 is also used to control extension and retraction of the displacement assembly 131, as well as sideshift functions of the carriage assembly 130, which will be described in greater detail below.

The truck 110 also includes optical sensor structure 60, which in the embodiment shown comprises first and second optical, e.g., laser, sensors 62 affixed to opposed outer sides of the lower mast member 132. The sensors 62 are preferably located adjacent, i.e., in close proximity to the outriggers 124 and laterally inwardly of the corresponding outriggers 124, although the sensors 62 could be located in other suitable locations. The sensors 62 monitor respective areas $A_{62}$ around the outriggers 124 for a portion of a load carried on the forks 138 to enter one or both of the respective areas $A_{62}$, wherein signals from the sensors 62 are sent to the controller 152. The controller 152 uses the signals from the sensors 62 to ensure that contact between the load and the outriggers 124 does not occur, e.g., as a result of vertical or lateral movement of the carriage assembly 130 and/or longitudinal movement of the mast assembly 128. The general areas $A_{62}$ monitored by the sensors 62 can be seen in FIGS. 4 and 5. As shown, the areas $A_{62}$ monitored by the sensors 62 extend longitudinally forward from and vertically downward from each respective sensor 62.

When the carriage assembly 130 is above a predetermined threshold height, which may be, for example, about 70 cm (about 27.5 inches), or when the mast assembly 128 is in a fully extended position such that the fork carriage 140 is located forward of the outriggers 124, the truck controller 152 assumes that there would be no potential contact between a load 200 carried on the forks 138 and the outriggers 124. In either of these situations, full operation of the load handling assembly 126, including raise/lower, sideshift, reach, tilt, etc., is enabled. However, if each of these criteria is not met, the controller 152 may restrict one or more functions of the load handling assembly 126, as will now be described.

Figure 4:
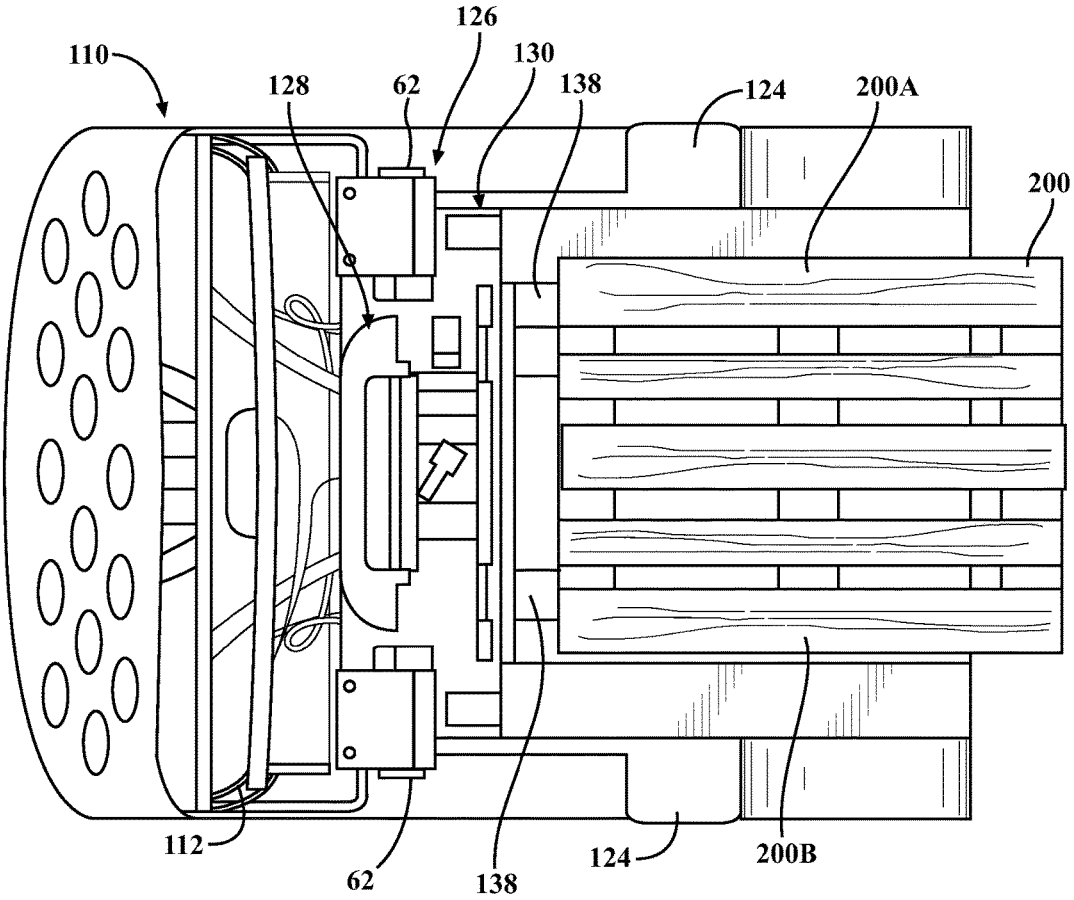
FIGS. 4 and 5 are views showing a load handling assembly of the lift truck of FIGS. 2 and 3 in a home position.
Figure 5:
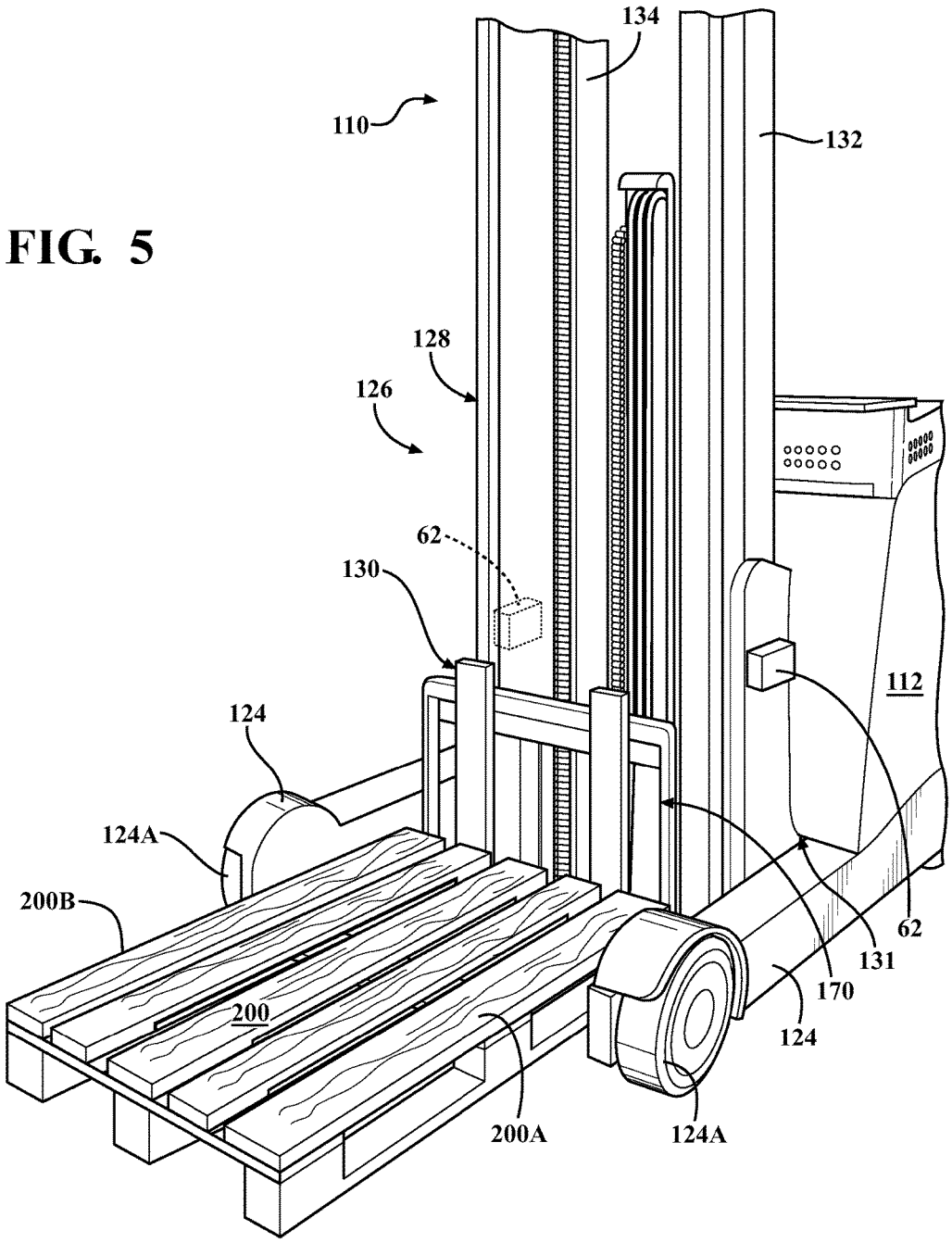

Referring to FIGS. 4-9, the load handling assembly 126 of the truck 110 illustrated in FIGS. 2 and 3 is shown in various positions. FIGS. 4 and 5 illustrate the load handling assembly 126 in a fully retracted and lowered position, referred to herein as a "home position," and FIGS. 6-9 illustrate the load handling assembly 126 not in fully retracted and/or lowered positions, referred to herein as "non-home positions."

As shown in FIGS. 4 and 5, the mast assembly 128 is in a fully retracted position, i.e., the mast assembly 128 is located immediately adjacent to the truck frame 112, and the carriage assembly 130 is in a fully lowered position, below the threshold height. The load 200 carried on the forks 138 is completely located between the outriggers 124 in FIGS. 4 and 5, i.e., first and second lateral edges 200A, 200B of the load 200 are located laterally inwardly from the respective outriggers 124. With the load 200 in the position shown in FIGS. 4 and 5, raising and lowering of the carriage assembly 130 is enabled by the controller 152, as well as movement of the mast assembly 128 laterally away from the vehicle frame 112 and then back toward the vehicle frame 112, i.e., toward the home position.

With reference to FIGS. 6-9, the load 200 is not completely located between the outriggers 124 in each of these figures. Specifically, in FIG. 6, the load 200 extends laterally over each of the outriggers 124, the carriage assembly 130 is below the threshold height, and the mast assembly 128 is not in a fully extended position; in FIGS. 7 and 8, the load 200 is offset on the forks 138 and extends laterally over the outrigger 124 depicted on the right in FIGS. 7 and 8 (hereinafter "right outrigger 124"), the carriage assembly 130 is below the threshold height, and the mast assembly 128 is not in a fully extended position; and in FIG. 9, the load 200 is positioned in front of the right outrigger 124, the carriage assembly 130 is below the threshold height, and the mast assembly 128 is in a fully extended position.

Function of the sensors 62 and the controller 152 with respect to each of FIGS. 6-9 will now be described.

Figure 6:
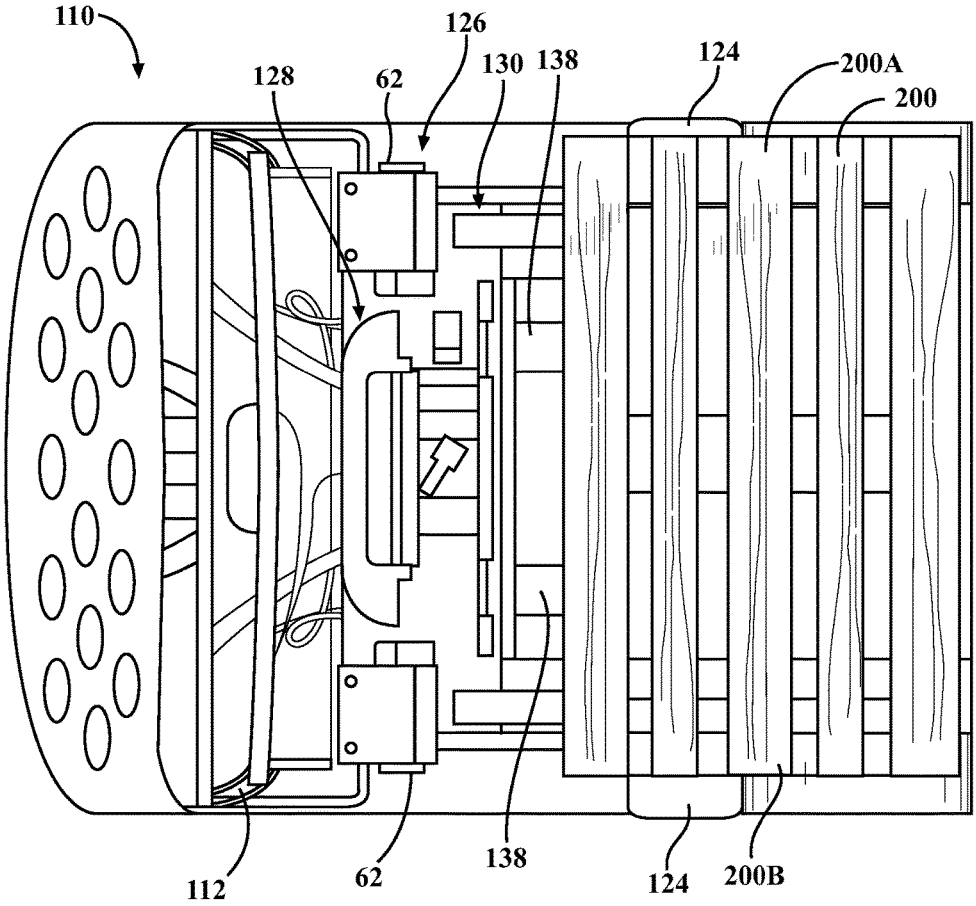
FIGS. 6-9 are views showing the load handling assembly of FIGS. 4 and 5 in various non-home positions.

With the load 200 in the position shown in FIG. 6, each sensor 62 detects that a corresponding one of the first and second lateral edges 200A, 200B of the load 200 is positioned in the sensor's monitored area $A_{62}$ over a respective outrigger 124. The signals from the sensors 62 are sent to the vehicle controller 152, which prevents movement of the carriage assembly 130 back to the home position, i.e., in a downward direction toward the outriggers 124 as shown in FIG. 6, as such movement would result in undesirable contact between the load 200 and each of the outriggers 124. However, upward movement of the carriage assembly 130, lateral movement of the carriage assembly 130, i.e., using the sideshift assembly 170, and longitudinal movement of the mast assembly 128 in a direction away from the truck frame 112 may still be enabled by the controller 152 with the load 200 in the position shown in FIG. 6.

Figure 7:
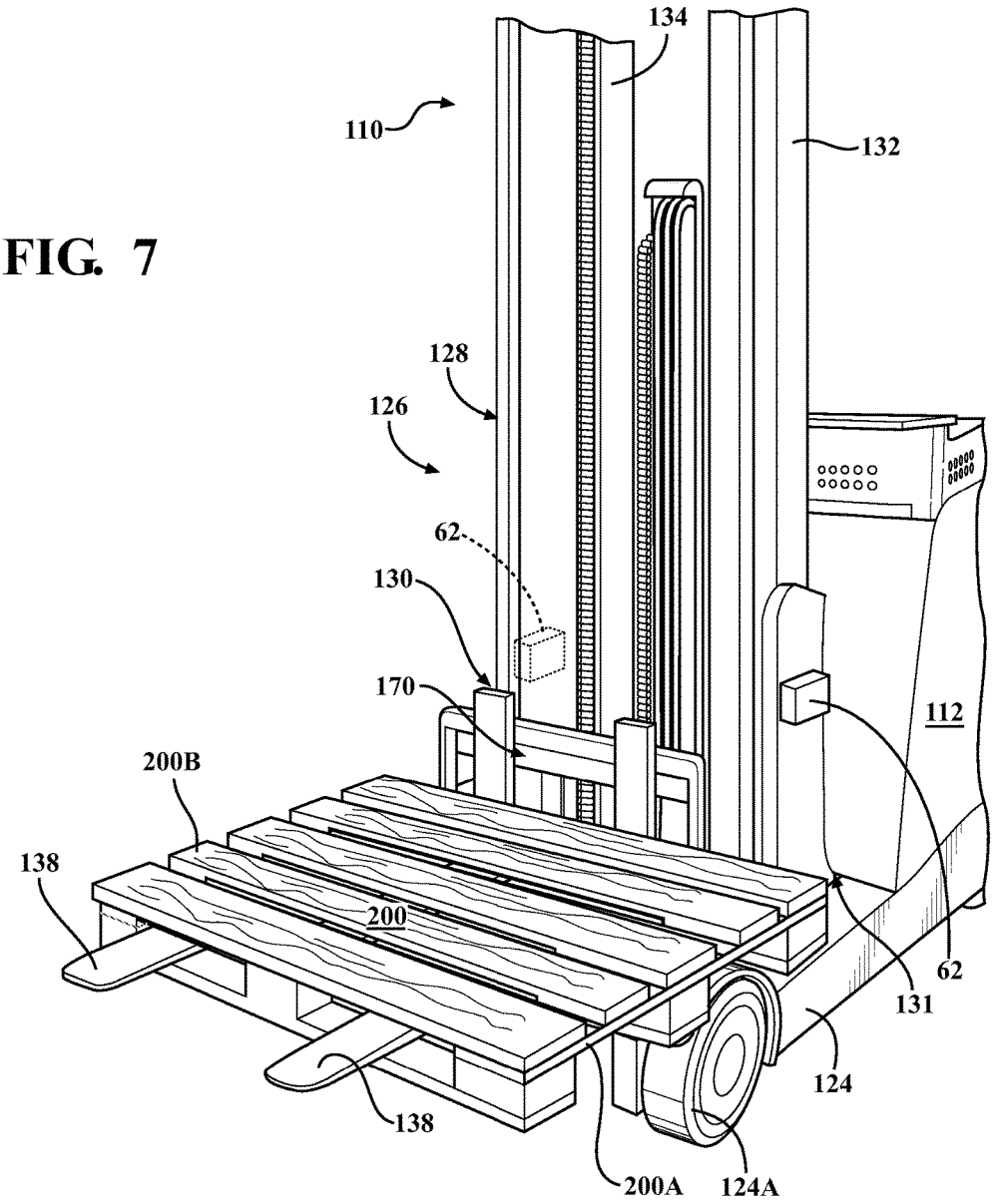
Figure 8:
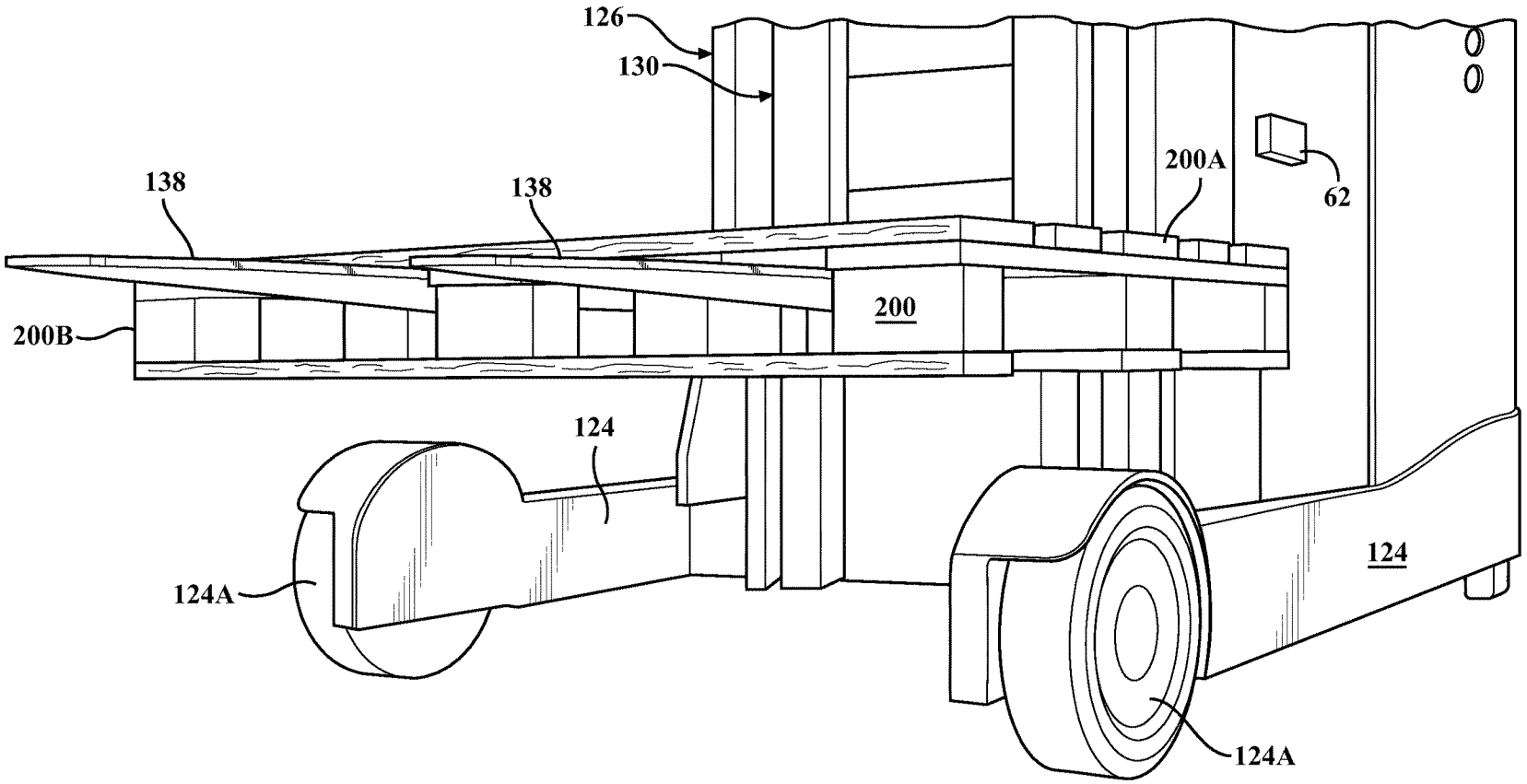

Referring now to FIGS. 7 and 8, with the load 200 positioned as shown, the sensor 62 depicted on the right in FIGS. 7 and 8 (hereinafter "right sensor 62") detects that the first lateral edge 200A of the load 200 is positioned in the monitored area $A_{62}$ over the right outrigger 124. The signals from the right sensor 62 corresponding to detection of an objection in its corresponding monitored area $A_{62}$ are sent to the vehicle controller 152, which prevents movement of the carriage assembly 130 back to the home position, i.e., in a downward direction toward the outriggers 124 as shown in FIGS. 7 and 8, as such movement would result in undesirable contact between the load 200 and the right outrigger 124. However, upward movement of the carriage assembly 130, lateral movement of the carriage assembly 130, and longitudinal movement of the mast assembly 128 in a direction away from the truck frame 112 may still be enabled by the controller 152 with the load 200 in the position shown in FIGS. 7 and 8.

Figure 9:
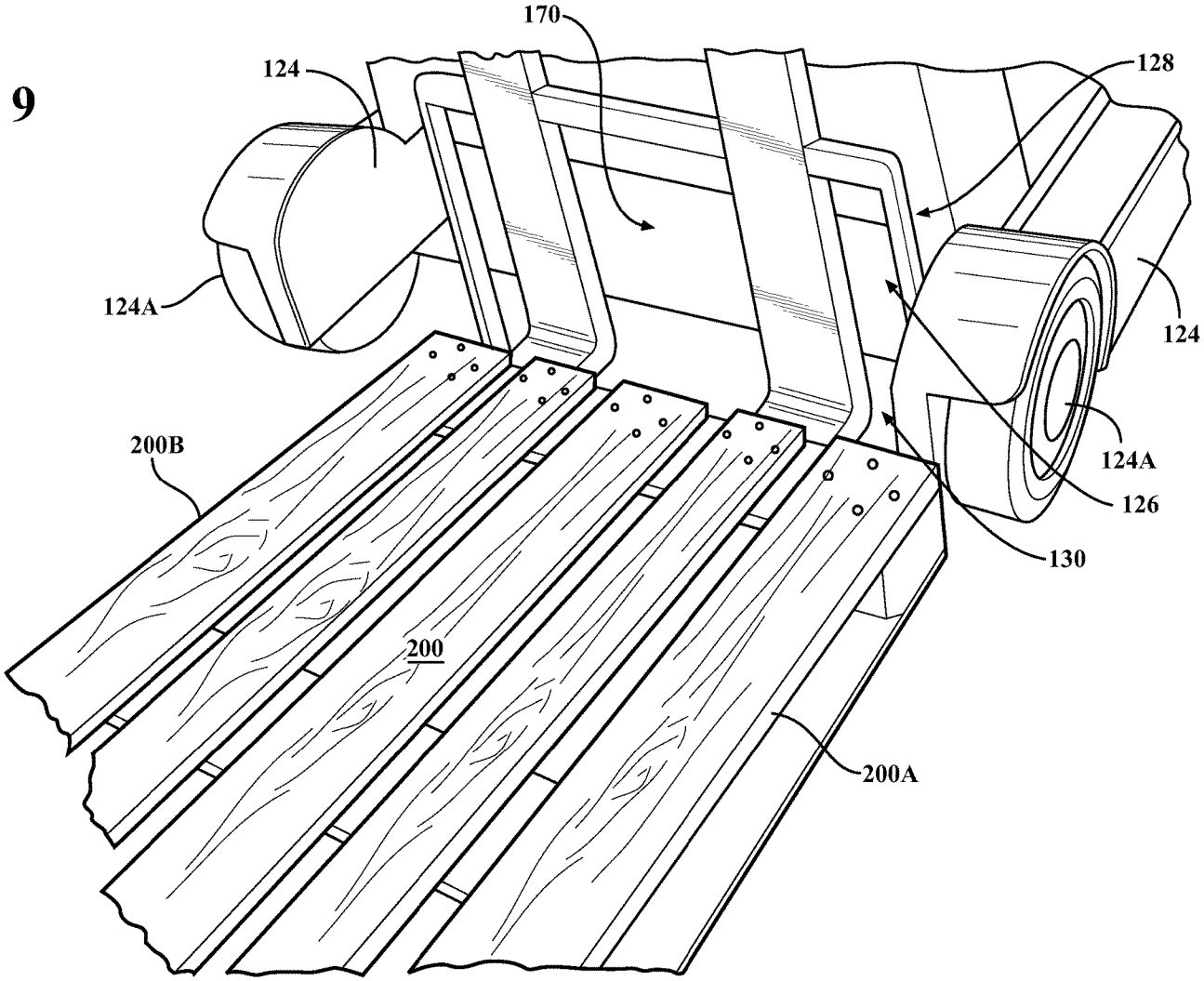

With the load 200 in the position shown in FIG. 9, the right sensor 62 detects that the first lateral edge 200A of the load 200 is positioned in the monitored area $A_{62}$ in front of the right outrigger 124. The signals from the right sensor 62 are sent to the vehicle controller 152, which prevents movement of the mast assembly 128 back to the home position, i.e., in a direction toward the truck frame 112 and toward the outriggers 124 as shown in FIG. 9, as such movement would result in undesirable contact between the load 200 and the right outrigger 124. However, upward movement of the carriage assembly 130, lateral movement of the carriage assembly 130, and longitudinal movement of the mast assembly 128 in a direction away from the truck frame 112 may still be enabled by the controller 152 with the load 200 in the position shown in FIG. 9.

In accordance with an aspect of the present invention, the signals from the sensors 62 may be usable by the controller 152 to perform an optional load centering function. For example, if the signal from one of the sensors 62 indicates potential contact between the load 200 and the corresponding outrigger 124, the controller 152 may prompt a vehicle operator with a request for the operator to command the controller 152 to perform a load centering function. The prompt may be presented on a conventional user display 180 (See FIG. 3), e.g., a touch screen, located in the operator's compartment 118. If the operator accepts the prompt, the controller 152 operates the sideshift assembly 170 to move the fork carriage 140 of the carriage assembly 130 laterally until the signals from the sensors 62 indicate that the load 200 is centered with respect to the outriggers 124.

Alternatively, the controller 152 may automatically perform a load centering function, i.e., without prompting the operator, if the signal from one of the sensors 62 indicates potential contact between the load 200 and the corresponding outrigger 124 and the operator requests a command that would potentially cause such contact, e.g., a reach in command, wherein the mast assembly 128 is retracted back toward the truck frame 112, or a lowering command, wherein the carriage assembly 130 is lowered toward the ground. If the controller 152 automatically performs a load centering function, the operator can control the speed of the sideshift assembly 170 using the control handle 120, wherein the speed of the sideshift assembly 120 corresponds to the amplitude of the command being requested by the operator, i.e., reach in or lower command. If the operator were to release the control handle 120, the amplitude of the requested command would go to zero (0), therefore stopping the sideshift assembly 170 and halting the automatic load centering function.

If the load centering function results in the load 200 being completely located between the outriggers 124, i.e., wherein the first and second lateral edges 200A, 200B are located laterally inwardly from the respective outriggers 124, the controller 152 enables movement of the load handling assembly 126 back to the home position until/unless the signal from one or both of the sensors 62 indicates potential contact between the load 200 and one or both of the outriggers 124.

In one example of this aspect of the invention, with reference to FIG. 9, the right sensor 62 detects that the first lateral edge 200A of the load 200 is positioned in front of the right outrigger 124, and the signals from the right sensor 62 are sent to the vehicle controller 152, as discussed above. In the case of the load being positioned as shown in FIG. 9, if the operator accepts the load centering prompt by the controller 152 (assuming that an operator prompt is utilized in this example), the controller 152 utilizes the sideshift assembly 170 to move the carriage assembly 130 and the load to the left as shown in FIG. 9. Once the load 200 is centered between the outriggers 124, which is determined by the controller 152 using the signals from the sensors 62, if the load 200 is completely located between the outriggers 124, the controller 152 permits movement of the load handling assembly 126 back to the home position, i.e., by moving the mast assembly 128 in a direction toward the truck frame 112 in the configuration shown in FIG. 9.

The load centering function works similarly in the configurations where the load 200 is located directly above the left and/or right outriggers 124 (rather than in front of the outriggers 124 as shown in FIG. 9).

It is noted that in the configurations shown in FIGS. 6-8, while the loads 200 depicted could be centered with respect to the outriggers 124 in each of these figures, the load 200 could not be positioned completely between the outriggers 124 without setting the load 200 down and rotating the load 200 or picking it up from a different direction, as the loads 200 depicted in these figures are wider than a width between the outriggers 124.

In accordance with an aspect of the present invention, a timeout algorithm may optionally be implemented to avoid a perpetual lateral oscillation of the fork carriage 140 between the left and right sensors 62 if the controller 152 is unable to successfully center a load 200 with respect to the outriggers 124 within a predetermined time period after commencement of the load centering function, i.e., the controller 152 may be programmed to discontinue the load centering function after the predetermined time period has lapsed. Upon expiration of the predetermined time period after commencement of the load centering function where the controller 152 is unable to successfully center the load 200 with respect to the outriggers 124, the controller 152 may prevent the implementation of lowering and reach in commands until a lifting or reach out command is implemented or the operator manually adjusts the position of the load 200 to a centered position between the outriggers 124.

It is also noted that conventional carriage assembly centering technology, wherein the carriage assembly 130 is centered between the outriggers 124 using one or more sensors and the sideshift assembly 170, could be used in the trucks 10, 110 described herein.

It is further noted that the present invention can be implemented without modification of the load 200, e.g., a pallet, carried by the trucks 10, 110, since the sensors 62 are capable of detecting potential contact between the truck outriggers 24, 124 and any object supported on the forks 138 that enters the monitored areas $A_{62}$.

In accordance with another aspect of the present invention, the vehicle controller 152 may be programmed to deactivate/override the restriction of vehicle functions, such as those based on the position of the load 200 as described herein. For example, a control element 300, illustrated in FIG. 3 as an icon on the user display 180 (although the control element could also be, for example, a knob, button, or switch provided in the operator's compartment 118), may be implemented by the operator, e.g., by the operator continuously implementing the control element, during which time the operator is able to freely control all mast and carriage assembly 128, 130 functions, including reach in, reach out, raise, lower, sideshift, etc. Upon the operator releasing the control element, the controller 152 may be programmed to reinstate the restriction of the vehicle functions based on the position of the load 200 as described herein.

While the function of the sensors 62 and the controller 152 have been discussed herein with reference to the truck 110 of FIGS. 2 and 3, the sensors 62 and controller 52 of the truck 10 described above for FIG. 1 function in a similar manner, with an exception that the carriage assembly 30 of FIG. 1 moves longitudinally from the mast assembly 28, i.e., via the reach mechanism 48, whereas the mast assembly 128 in the truck 110 of FIGS. 2 and 3 moves longitudinally relative to the truck frame 112. In the truck 10 of FIG. 1, if a portion of a load is positioned immediately in front of one of the outriggers 24 while the carriage assembly 30 is in a lowered position, i.e., below a predetermined threshold height, movement of the carriage assembly 30 in a direction toward the mast assembly 28 is prevented by the controller 52 until the load is completely located between the outriggers 24. The use of the sensors 62 and the controller 52 of FIG. 1 for carriage assembly lowering is the same as described above for the truck 110.

Finally, as an optional feature, the lowering speed of the carriage assembly 30, 130 may be limited depending on fork height, e.g., to soften the placement of the load 200 on the ground.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A lift truck comprising:

a frame defining a main structural component of the lift truck;

a pair of laterally spaced apart outriggers extending from the frame, each outrigger including at least one wheel;

a vehicle controller for controlling at least one function of the lift truck;

a load handling assembly secured to the frame adjacent to the outriggers, the load handling assembly comprising: a mast assembly positioned between the outriggers; and a carriage assembly including fork structure for supporting a load on the load handling assembly, the carriage assembly being movable vertically along the mast assembly and the fork structure also being moveable laterally with respect to the mast assembly via a sideshift assembly; and optical sensor structure that monitors for conditions wherein movement of the carriage assembly would result in contact between the load and at least one of the outriggers;

wherein the vehicle controller receives a signal from the optical sensor structure and prevents movement of the carriage assembly in a direction toward the at least one of the outriggers if the signal from the optical sensor structure indicates that such movement would result in contact between the load and the at least one of the outriggers.

2. The lift truck of claim 1, wherein the fork structure comprises a pair of laterally spaced apart forks extending longitudinally away from the frame.

3. The lift truck of claim 1, wherein the optical sensor structure comprises a pair of laterally spaced apart contactless optical sensors, each contactless optical sensor being located adjacent to a corresponding outrigger.

4. The lift truck of claim 3, wherein each contactless optical sensor monitors a respective area around the corresponding outrigger for a portion of the load to enter the respective area, wherein a portion of the load entering the respective area causes the vehicle controller to prevent movement of the carriage assembly toward the at least one of the outriggers.

5. The lift truck of claim 4, wherein the area monitored by each contactless optical sensor extends longitudinally forward from and vertically downward from the respective contactless optical sensor.

6. The lift truck of claim 4, wherein the contactless optical sensors are located laterally inwardly of the corresponding outriggers.

7. The lift truck of claim 4, wherein the contactless optical sensors are affixed to the mast assembly.

8. The lift truck of claim 4, wherein the contactless optical sensors are laser sensors.

9. The lift truck of claim 1, wherein the vehicle controller is capable of operating the sideshift assembly to cause the fork structure to move to a position such that the load is centered with respect to the outriggers if the signal from the optical sensor structure indicates that movement of the fork structure toward at least one of the outriggers would result in contact between the load and the at least one of the outriggers.

10. The lift truck of claim 9, wherein the vehicle controller operates the sideshift assembly to cause the fork structure to move only upon authorization to do so by an operator.

11. The lift truck of claim 9, wherein the controller discontinues attempting to center the load with respect to the outriggers after the expiration of a predetermined time period.

12. The lift truck of claim 1, wherein the load handling assembly is movable to a home position only if the signal from the optical sensor structure does not indicate that such movement would result in contact between the load and the outriggers.

13. The lift truck of claim 1, wherein:

the mast assembly is movable in a longitudinal direction relative to the frame;

the optical sensor structure also monitors for conditions wherein movement of the mast assembly would result in contact between the load and at least one of the outriggers; and the vehicle controller also prevents movement of the mast assembly in a direction toward at least one of the outriggers if the signal from the optical sensor structure indicates that such movement would result in contact between the load and the at least one of the outriggers.

14. The lift truck of claim 13, wherein the optical sensor structure comprises a pair of laterally spaced apart contactless optical sensors, each contactless optical sensor being located adjacent to a corresponding outrigger.

15. The lift truck of claim 14, wherein each contactless optical sensor monitors a respective area around the corresponding outrigger for a portion of the load to enter the respective area, wherein a portion of the load entering the respective area causes the vehicle controller to prevent movement of at least one of the mast assembly and the carriage assembly toward the at least one of the outriggers.

16. The lift truck of claim 14, wherein the area monitored by each contactless optical sensor extends longitudinally forward from and vertically downward from the respective contactless optical sensor.

17. The lift truck of claim 14, wherein the contactless optical sensors are located laterally inwardly of the corresponding outriggers.

18. The lift truck of claim 14, wherein the contactless optical sensors are located vertically above the carriage assembly when the load handling assembly is positioned in a home position.

19. The lift truck of claim 14, wherein the contactless optical sensors are affixed to the mast assembly.

20. The lift truck of claim 13, wherein the vehicle controller is capable of operating the sideshift assembly to cause the fork structure to move to a position such that the load is centered with respect to the outriggers if the signal from the optical sensor structure indicates that movement of the fork structure toward at least one of the outriggers would result in contact between the load and the at least one of the outriggers.

21. The lift truck of claim 20, wherein the controller discontinues attempting to center the load with respect to the outriggers after the expiration of a predetermined time period.

22. The lift truck of claim 1, wherein the carriage assembly is movable in a longitudinal direction relative to the mast assembly.

23. The lift truck of claim 1, further comprising a control element that is adapted to be implemented by an operator to override the prevention of movement of the carriage assembly in the direction toward the at least one of the outriggers even if the signal from the optical sensor structure indicates that such movement would result in contact between the load and the at least one of the outriggers.

24. The lift truck of claim 23, wherein the operator is able to override the prevention of movement of the carriage assembly in the direction toward the at least one of the outriggers for as long as the operator implements the control element.

25. A lift truck comprising:

a frame defining a main structural component of the lift truck;

a pair of laterally spaced apart outriggers extending from the frame, each outrigger including at least one wheel;

a vehicle controller for controlling at least one function of the lift truck;

a load handling assembly secured to the frame adjacent to the outriggers, the load handling assembly comprising:

a mast assembly positioned between the outriggers; and a carriage assembly including fork structure for supporting a load on the load handling assembly, the carriage assembly being movable vertically along the mast assembly; and optical sensor structure that monitors for conditions wherein movement of the carriage assembly would result in contact between the load and at least one of the outriggers;

wherein the vehicle controller receives a signal from the optical sensor structure and prevents movement of the carriage assembly in a direction toward the at least one of the outriggers if the signal from the optical sensor structure indicates that such movement would result in contact between the load and the at least one of the outriggers.

26. A lift truck comprising:

a frame defining a main structural component of the lift truck;

a pair of laterally spaced apart outriggers extending from the frame, each outrigger including at least one wheel;

a vehicle controller for controlling at least one function of the lift truck;

a load handling assembly secured to the frame adjacent to the outriggers, the load handling assembly comprising:

a mast assembly positioned between the outriggers; and a carriage assembly including fork structure for supporting a load on the load handling assembly, the fork structure being moveable laterally with respect to the mast assembly via a sideshift assembly; and optical sensor structure that monitors for conditions wherein movement of the carriage assembly would result in contact between the load and at least one of the outriggers;

wherein the vehicle controller receives a signal from the optical sensor structure and prevents movement of the carriage assembly in a direction toward the at least one of the outriggers if the signal from the optical sensor structure indicates that such movement would result in contact between the load and the at least one of the outriggers.

* * * * *